US007791475B2

(12) United States Patent
Clow

(10) Patent No.: US 7,791,475 B2
(45) Date of Patent: Sep. 7, 2010

(54) APPARATUS AND METHOD OF BLOCKAGE DETECTION

(75) Inventor: Rob Clow, North Aurora, IL (US)

(73) Assignee: Honeywell International Inc., Morristown, NJ (US)

( * ) Notice: Subject to any disclaimer, the term of this patent is extended or adjusted under 35 U.S.C. 154(b) by 311 days.

(21) Appl. No.: 12/055,760

(22) Filed: Mar. 26, 2008

(65) Prior Publication Data

US 2009/0243843 A1 Oct. 1, 2009

(51) Int. Cl.
*G08B 21/00* (2006.01)

(52) U.S. Cl. ..... 340/540; 340/506; 340/607; 340/693.6; 367/93

(58) Field of Classification Search ..... 340/540, 340/628, 607, 603, 506, 630, 552; 367/93, 367/94

See application file for complete search history.

(56) References Cited

U.S. PATENT DOCUMENTS

| | | | | |
|---|---|---|---|---|
| 4,647,785 | A | 3/1987 | Morita | |
| 5,247,283 | A | 9/1993 | Kobayashi et al. | |
| 5,757,271 | A * | 5/1998 | Andrews | 340/568.1 |
| 6,011,470 | A * | 1/2000 | Schulte et al. | 340/552 |
| 6,469,623 | B2 | 10/2002 | Pattok et al. | |
| 7,015,820 | B2 | 3/2006 | Bobenhausen | |

* cited by examiner

*Primary Examiner*—George A Bugg
*Assistant Examiner*—Hongmin Fan
(74) *Attorney, Agent, or Firm*—Hush Blackwell Sanders Welsh & Katz

(57) ABSTRACT

An apparatus includes a mounting base and a compatible electrical unit removably carried on the base. The base carries a transducer and a sensor external to the unit. The transducer emits radiant energy toward the unit. The sensor receives radiant energy modulated by the unit. A local control unit can store the received, modulated radiant energy as a base-line profile. Subsequently, additional profiles can be generated and compared to the stored base-line to determine is a spatial characteristic of the electrical unit has changed.

22 Claims, 3 Drawing Sheets

APPARATUS AND METHOD OF BLOCKAGE DETECTION

FIELD

The invention pertains to electrical units such as ambient condition detectors. More particularly, the invention pertains to such detectors which incorporate circuitry to detect obstruction of flow of local ambient atmosphere.

BACKGROUND

Smoke detectors have been recognized as useful and effective devices in providing warnings of smoke in the adjacent, local ambient atmosphere. In the presence of smoke, such devices can emit an audible, alarm indication.

Where detector inflow ports have been accidentally or intentionally obstructed, the devices may not work as intended. At times, smoke detectors have been, or might be intentionally obstructed to prevent detection of smoke from cigarettes in offices, dormitories, or hotels. During new construction, or during renovations, dust covers used to protect detectors from contamination might be unintentionally left in place after initial installation, or, after the renovation has been completed.

There is a need to minimize any likelihood that one or more detectors of an alarm, or monitoring system, might not function properly due to the presence of an obstruction which blocks inflow of local ambient atmosphere into the respective detector or detectors. Preferably such functionality would be readily installable in existing monitoring systems, and would not compromise normal functioning of the respective detector(s). It would also be desirable if blockage indicating audible, visible or electrical indicia could be provided on a per detector basis to facilitate identification and correction of the problem.

DETAILED DESCRIPTION

Figure 1:
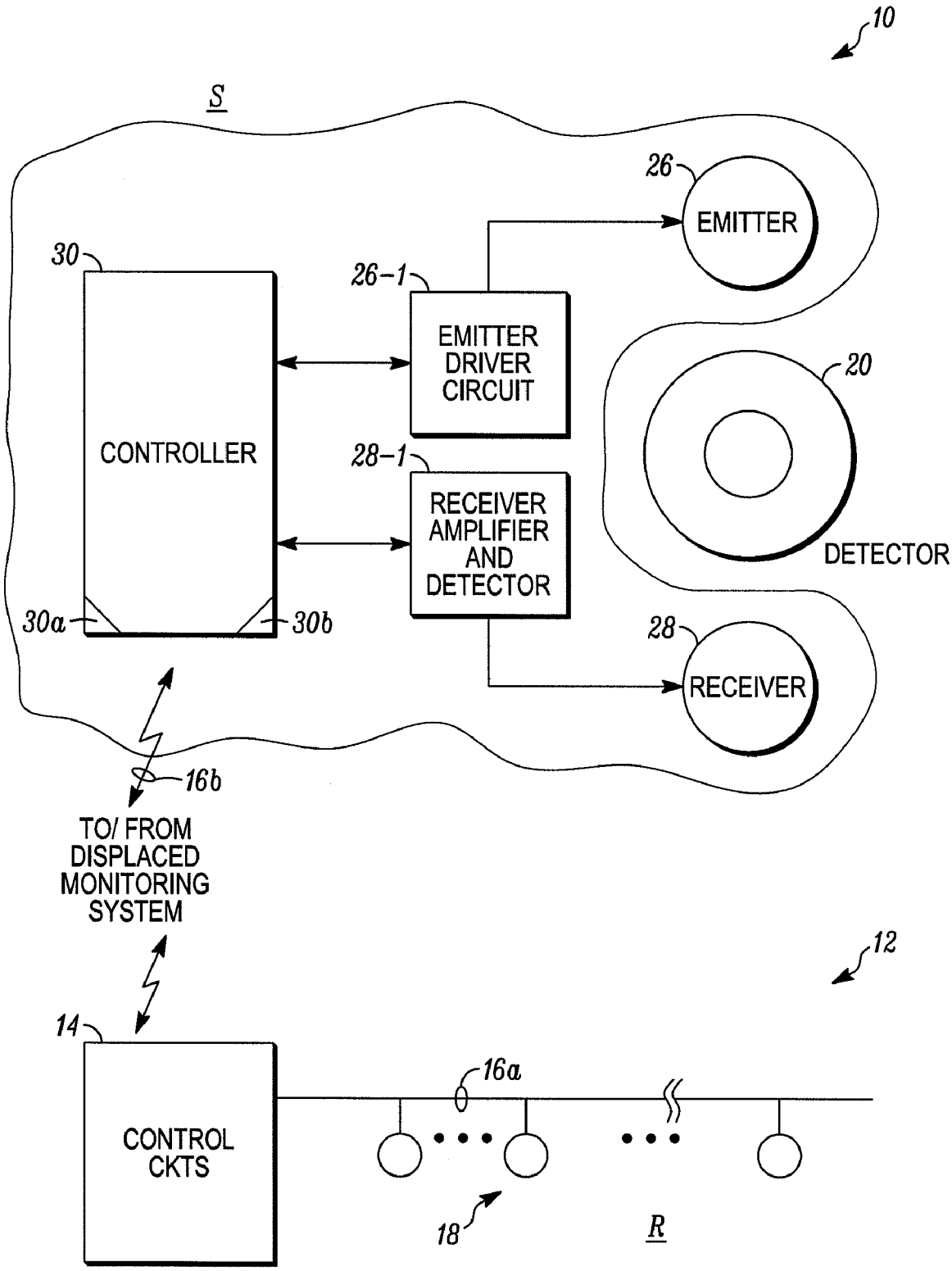
FIG. 1 is a block diagram of an electrical unit which embodies the present invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In one aspect of the invention, an ultrasonic emitter and receiver can be positioned on a housing or base of an electrical unit, such as a smoke detector, such that a portion of the unit, such as a sensing chamber, lies between them. The emitter can be energized when the unit is functioning properly and is not improperly obstructed in any way. The receiver responds to received ultrasonic energy. The received energy represents a profile of the unit in the absence of any obstructions.

In the presence of an obstruction, the characteristics of the energy incident on the receiver due to path changes, absorption, reflections diffractions or the like will vary from the profile of the unit in the absence of any obstructions. The differences between the two profiles can be detected and obstruction indicating indicia can be generated locally, or transmitted to a remote control center or unit.

FIG. 1 illustrates a system 10 which embodies the invention. System 10 can include a regional monitoring and alarm system generally indicated at 12. System 12 can include control circuits, or control unit, 14 which could be implemented with one or more programmable processors and associated control software.

Unit 14 is coupled via a wired or wireless medium 16*a*, 16*b* to a plurality 18 of ambient condition detectors such as smoke detectors, gas detectors, fire detectors, intrusion detectors, and the like all without limitation for the purpose of providing real-time monitoring of various conditions in a region R. Examples of such monitoring systems have been disclosed in U.S. Pat. No. 5,483,222 to Tice entitled "Multiple Sensor Apparatus and Method" which issued on Jan. 9, 1996 and U.S. Pat. No. 6,163,263 to Tice et al. entitled "Circuitry for Electrical Device in Multi-Device Communications System which issued on Dec. 19, 2000. Both the '222 and '263 patents are assigned to the Assignee hereof and are hereby incorporated by reference herein.

A representative one of the detectors 20 which is coupled to unit 14 has an associated mounting base 22. Base 22 can be used to releasibly attach detector 20 to a mounting surface S in the region R. Those of skill in the art will understand that with use of the base 22 a variety of detectors, output modules or output appliances can easily be coupled to system 14. All such units come within the spirit and scope of the invention.

Base 22 carries an ultrasonic emitter 26 and a receiver 28. The emitter 26 and receiver 28 are positioned on the base 22 with detector, or other electrical unit, 20 located therebetween. Ultrasonic energy from emitter 26 is spatially modulated by the presence of detector 20 prior to being sensed at receiver 28.

The shape and physical characteristics of detector 20, or any other electrical unit carried on base 22, will produce a unique modulation, hence a profile that can be associated with the unit 20. Varying the shape of detector 20, for example by covering it with a plastic bag, will produce a different modulation and a different profile. This difference can be locally detected and used to produce obstruction indicia or trouble indicators.

Base 22 also carries emitter drive circuits 26-1 coupled to the emitter 26. Receiver amplifier and detection circuitry 28-1, carried on base 22 is coupled to receiver 28. Local controller 30, which could include a programmable processor 30*a*, and associated control software 30*b*, can be in bidirectional communication and coupled to circuits 26-1 and 28-1.

Controller 30 can in turn activate emitter 26 and obtain, via receiver 28 an ultrasonic profile of detector 20. Controller 30 can store and analyze that profile, including comparing it to previously received profiles of detector 20 to determine if operation of detector 20 has been impaired by an obstruction. Controller 30 can generate local audible and/or visual indicia indicative of an obstruction. Alternately, controller 30 can communicate such indicia, via medium 16*b*, to unit 14 for follow-up action or maintenance.

It will be understood that circuitry illustrated on base 22 is exemplary only. Alternates to the ultrasonic emitter 26 and receiver 28 come within the spirit and scope of the invention. It will also be understood that the nature of the electrical unit 20 is not a limitation of the invention. Further, some or all of the units 18 can include a base, such as base 22 which can be used to monitor conditions of an associated electrical unit without departing from the spirit and scope of the invention.

Figure 2:
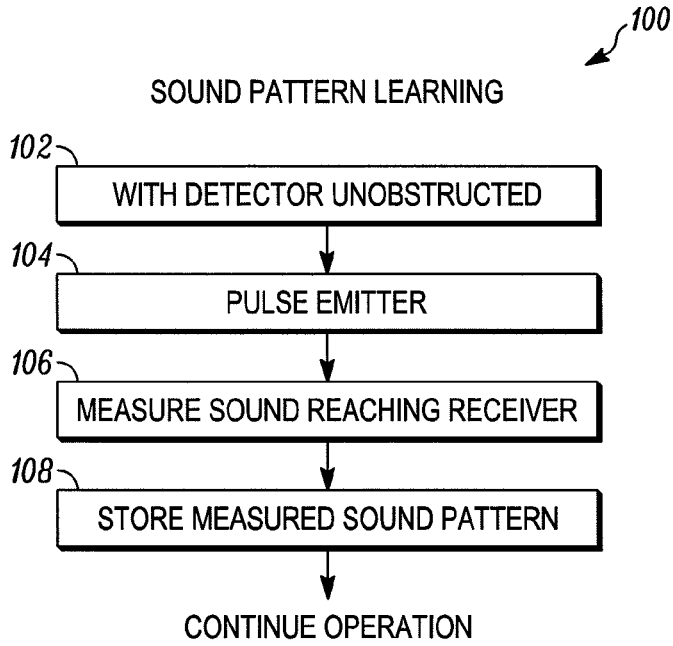
FIG. 2 is a flow diagram of a method in accordance with the invention.

FIG. 2 is a flow diagram of a process 100 in accordance with the invention. Process 100 establishes an expected profile of detector or electrical unit 20, mounted on base 22, when in a first state.

Where the detector 20 is exhibiting a first state, unobstructed for example, as at 102, emitter 26 can be activated, as at 104. Responsive to activating emitter 26, a profile of unit 20 can be sensed at receiver 28, as at 106. The received pattern or profile can be stored by controller 30, for subsequent use, as at 108. Normal operation can then continue.

Figure 3:
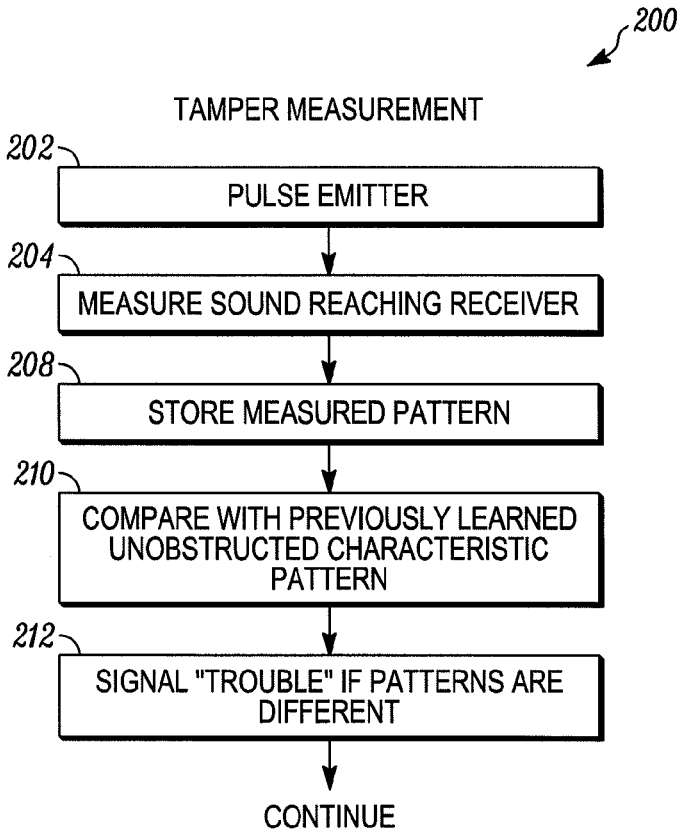
FIG. 3 another flow diagram which illustrates additional aspects of a method in accordance with the invention.

FIG. 3 is a flow diagram of a process 200 also in accordance with the invention. Process 200 establishes a current profile of detector or electrical unit 20 mounted on base 22 to determine if it continues to exhibit the first state.

Emitter 26 can be pulsed or activated, as at 202 where the control circuits generate a time sequential sequence of indicators. A sound pattern sensed at receiver 28, as at 204, can be stored, as at 208 by the controller 30. Controller 30 can compare a previously established profile, as at 108 of process 100, to a current profile as at 210, to determine if an obstruction is present. In the event of a detected difference, indicating a change in status of unit 20, controller 30 can generate local audible or visible indicia there of, or communicate same to control circuits 14 for inspection or maintenance, as at 212. Controller 30 can continue carrying out other functions as previously established.

Figure 5:
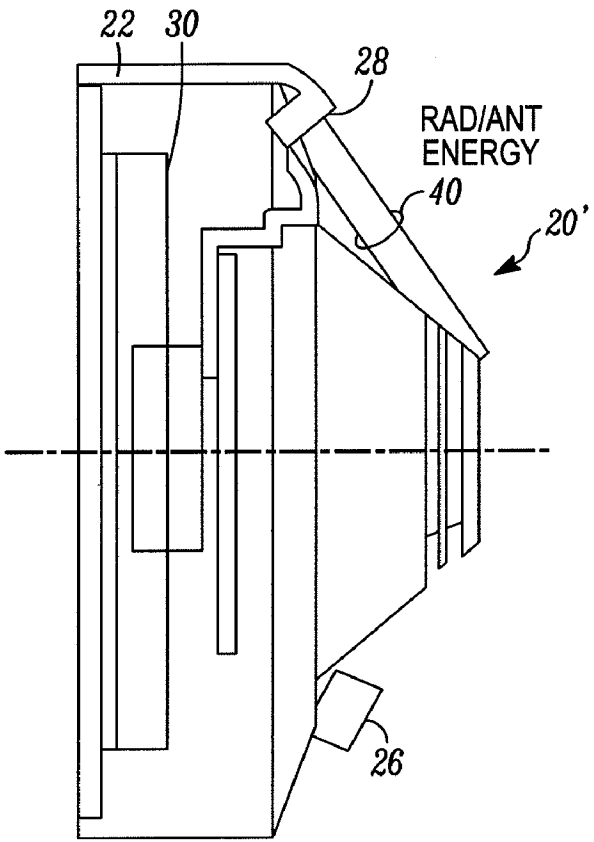
FIG. 5 is a sectional view taken along plane 5-5 of FIG. 4.
Figure 4:
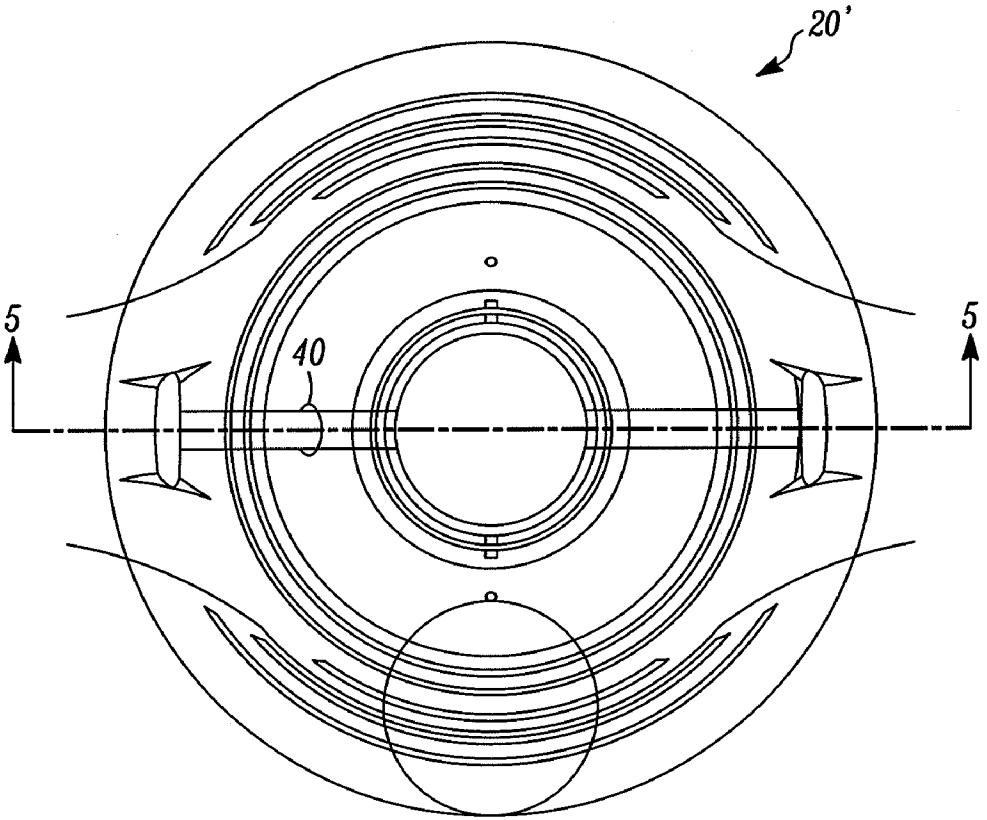
FIG. 4 is a top plan view of a smoke detector which embodies the invention.

FIG. 4 and FIG. 5 illustrate a smoke detector 20' mounted on a base 22. Radiant energy 40, illustrated pictorially only, emitter by transducer 26 is angled toward the smoke entry area of the detector 20'. At least a portion of the ultrasonic energy will pass through the detector's smoke chamber and be sensed, in spatially modulated form by receiver 28. As noted above, each type of electrical unit or detector mounted on a base, such as base 22, can be expected to produce its own profile in both unobstructed and obstructed states.

Those of skill in the art will understand that the unobstructed profile could be sensed and factory programmed, at time of manufacture for example, into each unit for subsequent use. Such pre-stored profiles could be transmitted to an adjacent base, where a base is used, when the unit or detector is mounted in the field.

In another aspect of the invention, embodiments hereof do not require a base. In such embodiments, an emitter and sensor of obstruction sensing radiant energy for example, could be mounted on the respective unit or detector. In yet another embodiment, one of the transducers could be mounted inside the unit or detector, such as in a sensing chamber of a smoke detector. In such embodiments, it may not be necessary to make a comparison to an unobstructed profile. In another embodiment, an ultrasonic emitter could be mounted in a detector and an ultrasonic sensor mounted outside of the detector. Only one need be mounted on the detector. The other could be mounted on an adjacent base.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A tamper indicating electrical apparatus comprising:

an electrical unit that carries out a predetermined environmental function;

a sensing chamber carried by the electrical unit that senses a parameter of the predetermined environmental function;

an emitter of selected radiant energy positioned adjacent to the electrical unit and outside the sensing chamber and where at least a portion of the emitted radiant energy passes through the sensing chamber; and a receiver of the emitted radiant energy located adjacent to the unit and outside the sensing chamber where received energy including at least a portion passing through the sensing chamber forms a status profile of the unit indicative of the unit being in a first state.

2. An apparatus as in claim 1 which includes circuitry that stores the status profile.

3. An apparatus as in claim 2 which includes control circuitry coupled to the emitter, the receiver and the circuits that store the status profile.

4. An apparatus as in claim 3 where the control circuitry intermittently activates the emitter to form at least one subsequent profile indicative of a subsequent state of the unit.

5. An apparatus as in claim 4 where the control circuits compare the status profile with the at least one subsequent profile, and responsive thereto, generate a state specifying indicator.

6. An apparatus as in claim 4 where the control circuits generate a time sequential sequence of indicators.

7. An apparatus as in claim 1 where the emitter comprises an emitter of sound.

8. An apparatus as in claim 1 where the electrical unit comprises an ambient condition detector selected from a class which includes at least smoke detectors, gas detectors, thermal detectors, intrusion detectors, and flow detectors.

9. An apparatus as in claim 1 which includes a mounting base for the electrical unit.

10. An apparatus as in claim 9 where at least the emitter is carried on the base.

11. An apparatus as in claim 10 where the base carries control circuitry coupled to the emitter and the receiver.

12. An apparatus as in claim 11 where the emitter comprises an emitter of ultrasonic radiant energy.

13. An apparatus as in claim 12 where the electrical unit comprises an ambient condition detector selected from a class which includes at least smoke detectors, gas detectors, thermal detectors, intrusion detectors, and flow detectors.

14. An apparatus as in claim 13 where the control circuitry intermittently activates the emitter to form at least one subsequent profile indicative of a subsequent state of the unit, and, where the control circuits compare the status profile with the at least one subsequent profile, and responsive thereto, generate a state specifying indicator.

15. An apparatus as in claim 1 where the emitter is located outside of the electrical unit.

16. An apparatus as in claim 1 where the emitter is mounted on one of, a base for the electrical unit, or, on the electrical unit.

17. A method comprising:

storing a representation of radiant energy spatially modulated at least in part by an internal sensing chamber carried by a selected electrical unit;

subsequently, emitting radiant energy so at least some of it is incident on and passes through the internal sensing chamber of the electrical unit during a selected time interval;

sensing at least some of the radiant energy subsequent to it being incident on the electrical unit;

forming a second representation of sensed radiant energy associated with the selected time interval; and comparing the two representations.

18. A method as in claim 17 which includes, responsive to the comparing, generating an indicator thereof.

19. A method as in claim 18 where emitting comprises emitting a beam of ultrasonic energy toward a least a part of the electrical unit.

20. A method as in claim 19 which includes using the electrical unit to spatially modulate at least some of the radiant energy incident thereon and, where sensing comprises sensing at least some of the spatially modulated radiant energy.

21. A method as in claim 20 which includes selecting the electrical unit from a class which includes at least smoke detectors, gas detectors, thermal detectors, intrusion detectors, and flow detectors.

22. A monitoring system comprising:

a plurality of ambient condition detectors, the detectors are selected from a class which includes at least smoke detectors, gas detectors, thermal detectors, intrusion detectors, and flow detectors;

a sensing chamber associated with each of the plurality of ambient condition detectors that senses an ambient condition of the selected class;

control circuitry coupled to each of the detectors via at least one medium; and where at least one of the detectors carries out a predetermined detecting function and which includes, an emitter of selected radiant energy located outside of, and adjacent to the respective detector and outside the sensing chamber where at least some of the emitted radiant energy passes through the sensing chamber; and a receiver of the emitted radiant energy located adjacent to the respective detector and outside the sensing chamber where received energy including at least a portion passing through the sensing chamber forms a status profile of the detector indicative of the detector being in a first state.

* * * * *